US005340275A

United States Patent [19]

Eisinger

[11] Patent Number: 5,340,275

[45] Date of Patent: Aug. 23, 1994

[54] ROTARY THROAT CUTOFF DEVICE AND METHOD FOR REDUCING CENTRIFUGAL FAN NOISE

[75] Inventor: Frantisek L. Eisinger, Demarest, N.J.

[73] Assignee: Foster Wheeler Energy Corporation, Clinton, N.J.

[21] Appl. No.: 100,787

[22] Filed: Aug. 2, 1993

[51] Int. Cl.[5] ..... F01D 5/10

[52] U.S. Cl. ..... 415/119; 181/224

[58] Field of Search ..... 415/119; 181/224, 225, 181/274

[56] References Cited

U.S. PATENT DOCUMENTS

| | | | |
|---|---|---|---|
| 2,160,666 | 5/1939 | McMahan | 415/119 |
| 2,171,342 | 8/1939 | McMahan | 415/119 |
| 2,708,546 | 5/1955 | Caldwell | 415/148 |
| 3,113,634 | 12/1963 | Watters | 415/119 |
| 4,260,037 | 4/1981 | Eline | 181/225 |
| 4,296,831 | 10/1981 | Bennett | 181/224 |
| 5,110,258 | 5/1992 | Morinushi et al. | 181/224 |

*Primary Examiner*—John T. Kwon
*Attorney, Agent, or Firm*—Marvin A. Naigur

[57] ABSTRACT

A rotary cutoff device for reducing noise generated by the impeller blading of rotating centrifugal fans. The rotary device includes a casing partially enclosing a rotor mounted near the centrifugal fan discharge opening. The rotor containing a plurality of resonator cavities consisting either of quarter wave length resonators or of Helmholtz type resonators, each cavity being oriented preferably transverse to the rotor axis and having a length/diameter ratio in the range of 8/1–16/1. The rotor can be rotatably adjustable relative to the fan impeller, or it can be driven by a motor at a surface speed 30–100% that of the fan impeller surface speed, so that the rotor resonator cavities act as either quarter wave length or Helmholtz resonators to absorb effectively the acoustic pulsations generated by the centrifugal fan blade pass frequency of the fan and its harmonics, and reduce substantially the noise generated by centrifugal fans.

17 Claims, 7 Drawing Sheets

ROTARY THROAT CUTOFF DEVICE AND METHOD FOR REDUCING CENTRIFUGAL FAN NOISE

BACKGROUND OF INVENTION

This invention pertains to noise reduction for centrifugal fans, and particularly pertains to a rotary cutoff device attachable to such fans and method for reducing noise pulsations produced by operation of the fan.

Centrifugal fans are widely used in steam generator/-power plant systems, process plants, mines, tunnel ventilation and other systems having requirements of moving large quantities of air or gases. It is known that these fans are inherently quite noisy, and special efforts have been exerted to reduce the emitted fan noise to environmentally acceptable levels. The standard noise reduction methods used include extensive sound insulation of the fan housing, sound insulation of the fan upstream and downstream ducting, and installation of fan inlet and discharge silencing equipment. However, such noise reduction methods add significantly to the fan installation costs, and the inlet and discharge silencers introduce pressure drop losses which lead to increased power consumption.

Because of these deficiencies in the known arrangements for noise reduction for centrifugal fans, various other noise reduction means have been developed. For example, U.S. Pat. No. 3,712,412 to Hassett discloses a sound suppressing system for high velocity fluid streams such as from high speed fans by using tunable resonating chambers. U.S. Pat. No. 4,174,020 and U.S. Pat. No. 4,279,325 to Challis disclose stationary sound insulation apparatus having cavities for acoustic treatment for centrifugal fans. Also, U.S. Pat. No. 4,475,621 to Cherington et al disclose use of acoustic sound reduction chambers for a combustion furnace. However, further improvements are needed for effective reduction of undesirable noise produced by large operating fans such as from centrifugal fans.

SUMMARY OF INVENTION

The present invention provides a rotary cutoff device adapted for attachment onto a centrifugal fan and method for its operation, so as to reduce fan noise at the location where most such noise is being generated, i.e., at the throat cutoff zone of the fan by the impeller blades passing that zone at high surface speeds. The rotary cutoff device can be provided either as an attachable unit or an integral part of a centrifugal fan assembly.

The rotary cutoff device essentially comprises a casing which is attachable to a fan housing and partially encloses a cylindrical shaped rotor, which rotor contains a plurality of quarter wave length and/or Helmholtz resonator cavities and is placed in the close proximity of the fan impeller blades. The rotor of this rotary cutoff device is rotatable and may have a variable speed drive arrangement, so that the relative flow velocity between the fan mean flow and the mouth of the rotor resonating chambers can be adjusted to allow an efficient resonator-pressure pulse interaction, thereby providing a significant reduction of the pressure pulses generated by the fan impeller blading at the blade pass frequency and its harmonics. These pressure pulses at the blade passing frequency and its harmonics are primarily responsible for the high noise levels produced by centrifugal fans. The noise frequency is determined by the relationship between the surface speed of the fan impeller and the number of fan impeller blades. This blade pass frequency for a centrifugal fan is given by the expression:

$$F\,bp = nb/60$$

where

F bp = blade pass frequency, Hz n = rotational speed of fan impeller, rpm

= number of blades in impeller

= frequency mode 1, 2, 3, etc.

It is understood that the rotary cutoff device of this invention replaces the conventional stationary throat cutoff means usually provided in the housing of centrifugal fans at the location where the housing discharge conduit intersects the scroll near the impeller. This cutoff device can be provided either in new centrifugal fan assemblies, or it can be retrofitted into existing centrifugal fans by removing the existing stationary cutoff means in the housing discharge opening and replacing it with the rotary cutoff device of this invention.

The resonator cavities provided in the cut off device rotor typically consist of quarter wave length tubular shapes or of Helmholtz resonator cavities, or both, with their outer end (mouth) being open and the inner end closed. The device rotor is provided with a full array of the resonating cavities, which for maximum effectiveness may densely fill the surface of the rotor in an in-line or a staggered pattern. The length of the resonator cavities will be less than the rotor diameter, and the length-to-diameter (L/d) ratio of the quarter wave length resonating cavities should preferably be in the range of 8/1–15/1 for optimal effectiveness in the first mode acoustic response. The resonator cavities are preferably oriented transverse to the rotor axis.

The cavity depth or length of a quarter wave length resonator is given by the relationship $L = c/4f$, where:

L = length of the resonator cavity, meter c = speed of sound in air or gas in the cavity, m/sec f = resonant frequency, Hz (either blade passing frequency and/or double blade passing frequency of fan)

This equation should be experimentally verified for any correction factors associated with the size of the mouth of the resonator, shape of resonator, added mass effects, etc.

Although the shape of the resonator cavities in the device rotor are typically straight cavities having circular cross section and oriented transverse to the rotor axis, other cross sectional shapes are acceptable, such as an L-shaped or U-shaped cavity, or any type of Helmholtz resonator cavity can be used. The Helmholtz resonator cavities are particularly advantageous, as these allow more cavities to be placed within the rotor, and also permits use of a smaller diameter rotor.

The fundamental frequency of a Helmholtz resonator is given by the equation:

$$f = c/2\pi \sqrt{S/l'V}$$

$$\text{with } l' = l + 6r/3\pi$$

where f = frequency of Helmholtz resonator, Hz (either blade passing frequency and/or double blade passing frequency of fan)

c = speed of sound in air or gas in the cavity, m/s s=cross-sectional area of the resonator opening or mouth, $m^2$ l'=effective length of resonator neck, m V=volume of resonator chamber (excluding volume of neck), $m^3$ l=length of resonator neck, m r=radius of resonator opening, m This frequency equation for the Helmholtz resonator should be experimentally verified for any correction factors associated with the mouth of and neck of the resonator, shape of cavity, added mass effects, etc.

For centrifugal fan/resonator rotor configurations in which the fan flow velocity relative to the rotor is insufficient to cause "acoustic plugging" of the resonator cavities in the rotor, the rotor can be rotatably adjustable so that the angle of the resonator cavities is variable relative to the plane / through the fan axis, so as to provide maximum sound reduction. For centrifugal fan/resonator rotor configurations in which the fan flow velocity causes acoustic plugging of the stationary resonant cavities in a stationary rotor, the rotor device may include drive means for rotating it at surface speeds relative to that of the fan impeller.

The rotation of the rotary cutoff device can be either in the same direction as the rotation of the centrifugal fan impeller, or it can be in the opposite direction to the fan rotation. The resonator device direction of rotation and its rotational and surface speeds are selected such that the centrifugal fan noise reduction effect is maximized.

The rotary cutoff device can be used on either constant speed or variable speed centrifugal fans. For variable speed fans, two features of the rotary cutoff device will differ: (1) The resonator cavities must be adjusted so as to cover a range of sound frequencies, which are typically a range of frequencies in the fan highest speed range where the noise is expected to be the highest. (2) The surface speed of the rotary cutoff device relative to fan impeller speed may need to be made adjustable relative to that of the fan impeller.

This rotary cutoff device is useful for centrifugal fans having impeller diameters of 18–144 inches. Useful rotor sizes for this cutoff device are 4–36 inch diameter by 8–48 inches long, with the preferred rotor size being 8–24 inch diameter by 12–36 inches long. The surface speed of the rotary cutoff device rotor should be in the range of 30–100% of the surface speed of the fan impeller, and is set so as to achieve maximum sound reduction for the centrifugal fan to which it is attached.

Typical impeller rotational speeds for centrifugal fans are 720–3,600 rpm, although for small fans higher rational speeds up to 5,200 rpm can be used. The corresponding fundamental sound frequencies produced by the blade pass frequency at the rotary cutoff device are typically in the range of 120–720 Hz for 10 and 12 bladed impellers operating at 720–3,600 rpm, with the first harmonic frequencies being twice as high.

The rotary cutoff resonator device of this invention overcomes the disadvantages of stationary i.e. non-rotatable type sound resonators usually used with centrifugal fans, which are relatively ineffective because of "acoustic plugging" of such resonators within a large range of air flow velocities and sound frequencies. This rotary cutoff resonator device having adjustable surface speed is able to overcome such acoustic plugging problems. This rotary cutoff device advantageously substantially reduces the blade pass frequency sound pulses and the first harmonics for centrifugal fans, such as by 20–25 decibels. This device also serves to reduce substantially or even eliminate the need for providing stationary sound insulation means around the centrifugal fan housing and its adjacent ducting.

BRIEF DESCRIPTION OF DRAWINGS

The invention will be further described with reference to the following drawings, in which.

DESCRIPTION OF INVENTION

Figure 1:
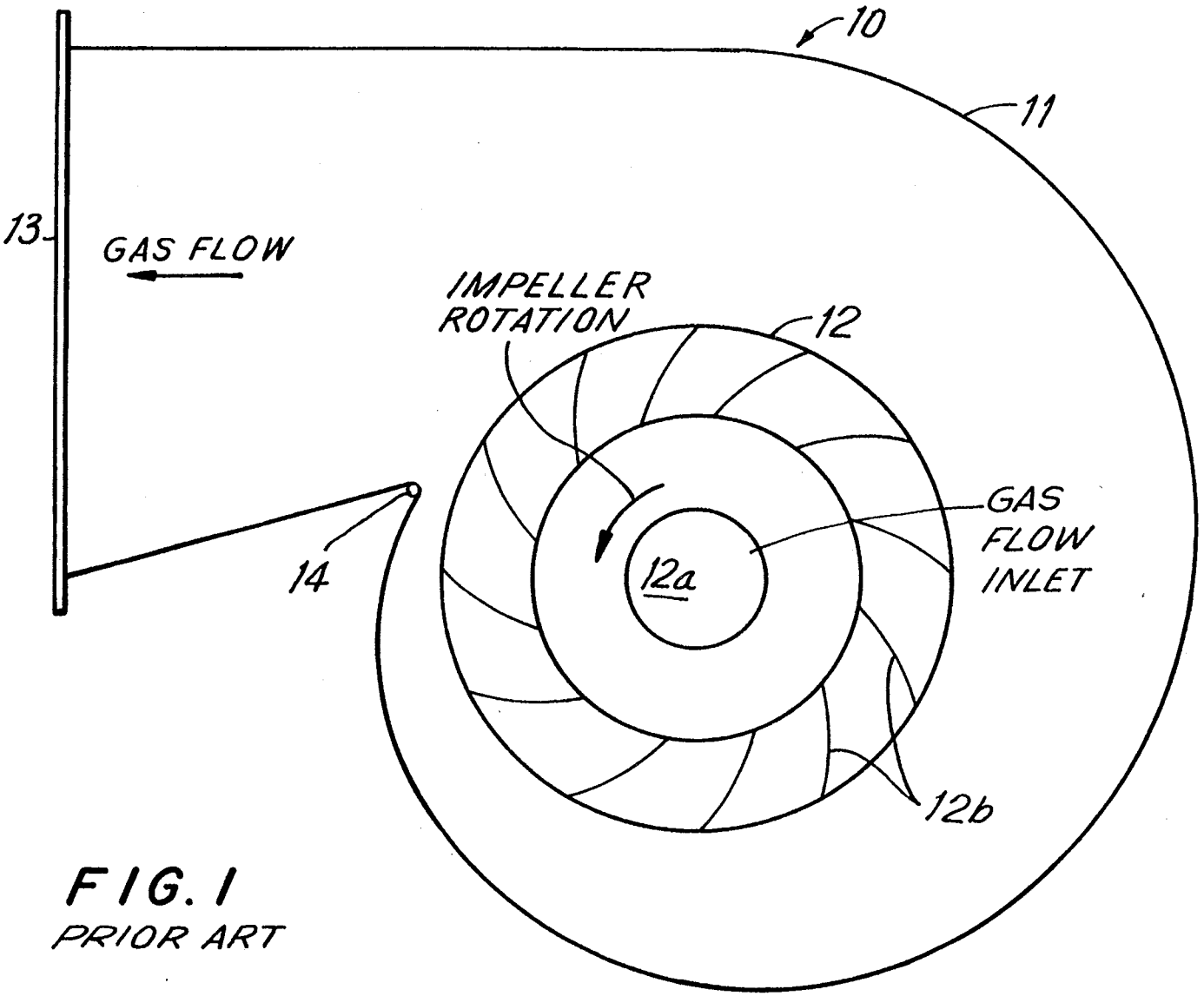
FIG. 1 PRIOR ART
FIG. 1 shows a general side view arrangement of a typical centrifugal fan having a conventional stationary throat cutoff configuration adjacent the fan discharge opening.

As shown by the FIG. 1 side view of a typical centrifugal fan the fan housing 11 is scroll-shaped to provide a gradually increasing cross-sectional area for gas flow through the housing. Fan housing 11 contains a rotatable impeller 12, which has a central gas flow inlet opening **12*a* and numerous blades 12*b*, such as 10–16 blades depending on the impeller diameter. It will be understood that during fan operation, gas flows from the impeller central inlet 12*a* radially outward between the blades 12*b*, and then through expanding housing 11 and discharge opening 13. Located at the intersection of housing 11 and discharge opening 13 near the impeller 12 is a conventional stationary type throat cutoff means 14. It has been found that blades 12*b* passing this stationary throat cutoff structure 14** at high velocity is a major cause of excessive undesirable pulsation noise which is produced by and emanates from conventional centrifugal fans during their operation.

Figure 2:
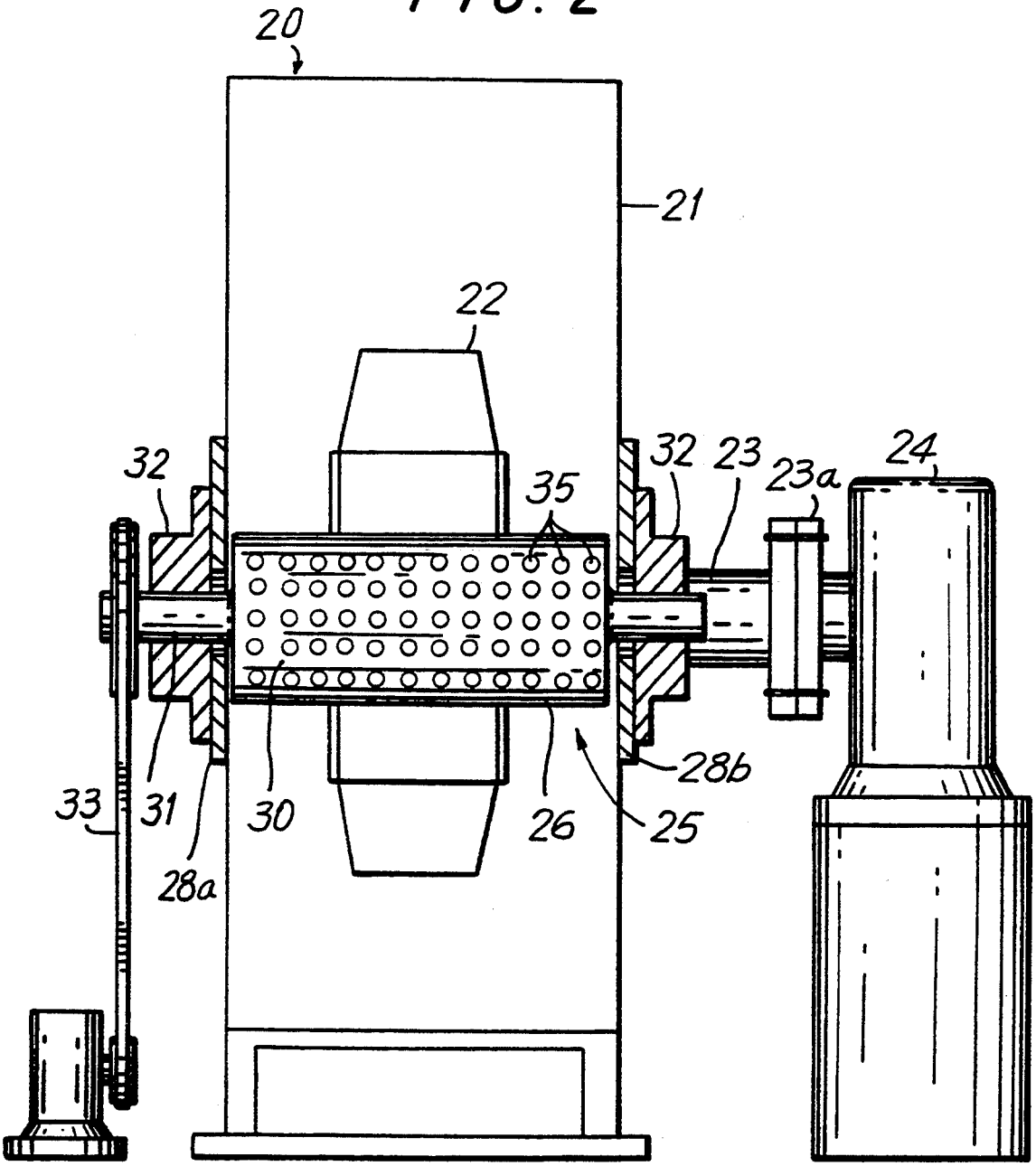
FIG. 2 shows a front elevation view of a centrifugal fan with motor drive assembly having a rotary cutoff device mounted onto the fan housing according to the invention.
Figure 3:
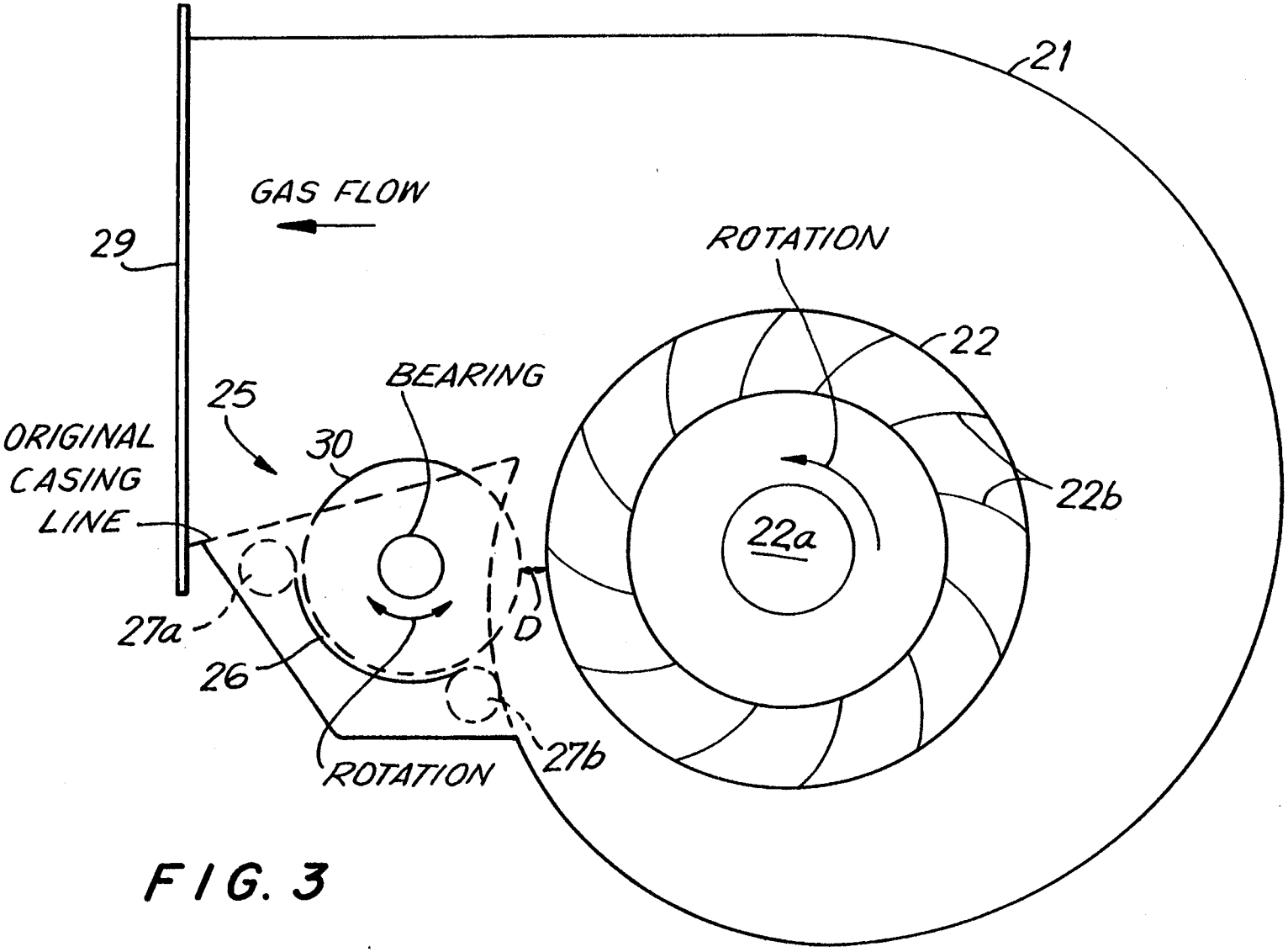
FIG. 3 shows a side elevation sectional view of a centrifugal fan assembly taken at line 2—2 of FIG. 2, and shows the mounting arrangement for the rotary throat cutoff device.

As shown by FIGS. 2 and 3, a centrifugal fan assembly 20 according to this invention includes housing 21 which contains a bladed impeller 22 mounted on a rotary shaft 23, which is direct-coupled by coupling means **23*a* onto a drive means such as electric motor 24 A rotary throat cut-off sound resonator device 25 is provided attached to the housing 21 of the centrifugal fan assembly at near the periphery of impeller 22 and the fan housing discharge opening 29. As best shown by FIG. 3, the fan housing 21 encloses the bladed impeller 22 which has central inlet opening 22***a* and multiple blades 22*b*, such as 10–14 blades. The rotary resonator device 25 includes a partial lower casing 26, which is supported by dual supports 27*a* and 27*b* and by dual end plates 28*a* and 28*b* which are attached to the fan housing 21 near and below the discharge opening 29. The lower casing 26 partially encloses an elongated cylindrical-shaped rotor 30, which is rotatably supported at each end by bearings 32, and is driven through drive means 33 such as a belt and pulleys by a variable speed motor 34. For achieving good noise reduction results, the distance "D" between the outer surface of the fan impeller 22 and the rotor 30 may be varied between about 1.0 inch for small diameter fan impellers up to about 6.0 inches for large diameter fans.

Figure 4:
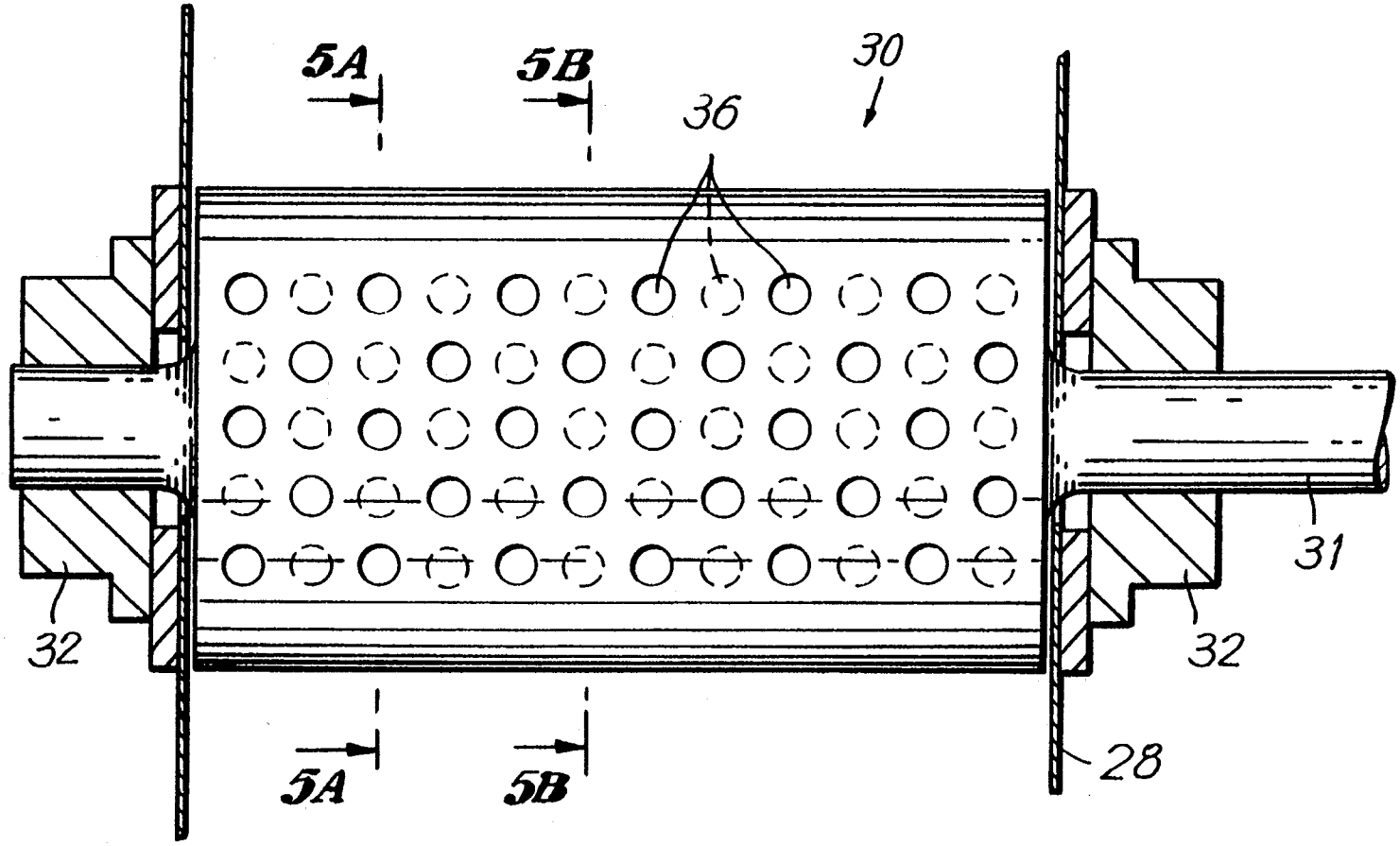
FIG. 4 shows an elevation view of the rotary cutoff device rotor having a specific in-line resonator cavity arrangement useful for a centrifugal fan.

As is further shown by FIG. 4, the rotor 30 having an extended drive shaft 31 is supported at each end by self-aligning bearings 32, which are attached to and supported by the end plates 28 and the fan housing 21.

Figure 5A:
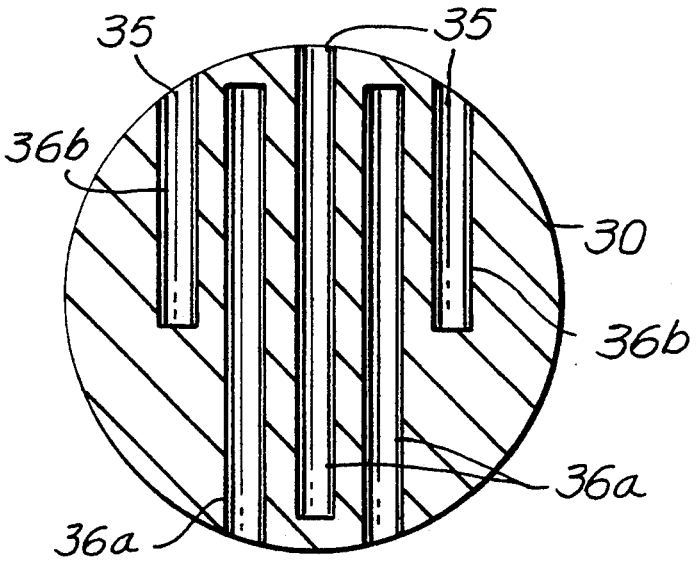
FIG. 5A and 5B show cross-sectional views taken at lines 5A and 5B of FIG. 4, and show details of the resonator cavities of a specific arrangement for a rotary cutoff rotor with the longer cavities being sized to resonate at the blade pass frequency of the fan and the shorter ones at twice the blade pass frequency (or the first harmonic).
Figure 5B:
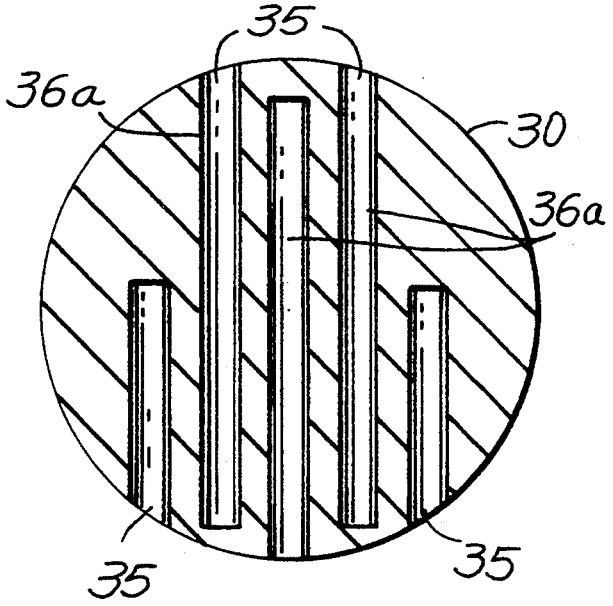

As shown in detail by FIGS. 4 and 5, the rotary resonator rotor 30 contains multiple resonant cavities 36 each extending transverse to the rotor axis and have varying depths or lengths. The location, size and shape of these cavities 36 is selected to provide a resonator for attenuation of various sound frequencies generated by the operation of the impeller blades 22*b* of the centrifugal fan 20. The rotor 30 contains at least 2 and usually 30–100 resonant cavities 36, which each have an outer opening 35 located at the rotor cylindrical surface. As shown by FIGS. 5*a* and 5*b*, the cavities 36 are preferably cylindrical-shaped and are preferably oriented transverse to the rotor axis, and have a length less than the rotor diameter and a length/diameter ratio in the range of 8/1–16/1. The cavities 36 include longer cavities 36*a* provided from opposite sides of the rotor for absorbing primary sound frequency, and shorter cavities 36*b* designed for absorbing first harmonics of the sound. Although the cavities 36 are shown in FIG. 4 in an in-line arrangement, they can alternatively be provided in a staggered arrangement in rotor 30.

For typical installations with centrifugal fans, the rotary cutoff device 25 can have a rotor diameter of 4–36 inches and a length of 8–48 inches depending upon the fan size. Such cutoff device can be attached to a centrifugal fan having an impeller diameter of 18–144 inches to provide an effectively silenced centrifugal fan assembly, with larger diameter impellers utilizing a larger diameter rotary cutoff device.

Figure 6:
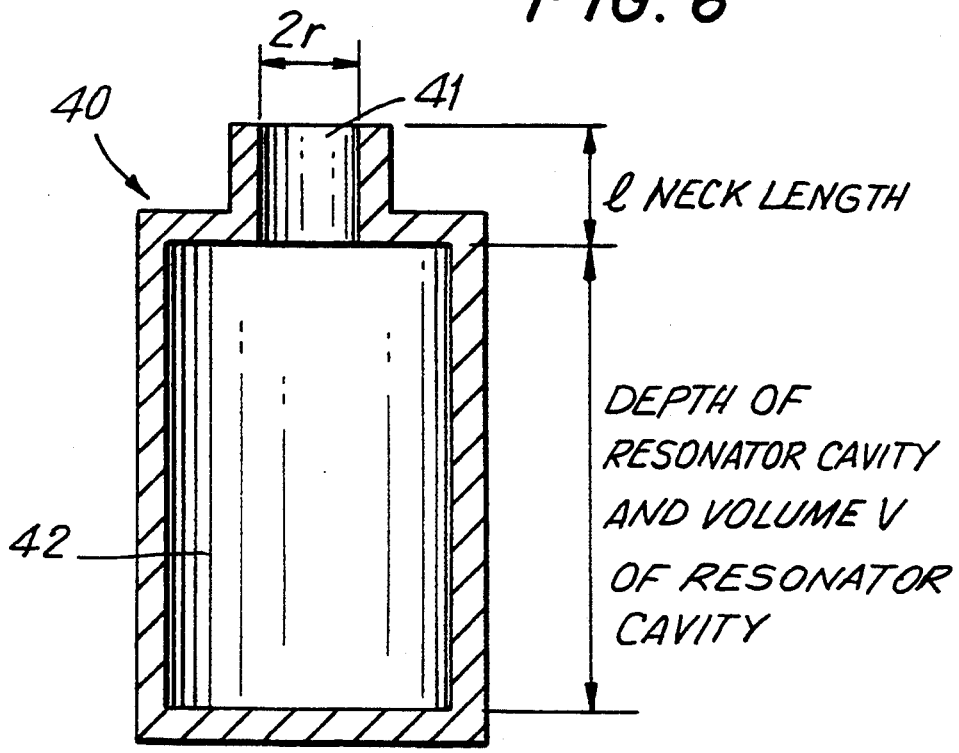
FIG. 6 shows a cross-sectional view of a typical Helmholtz resonator cavity useful for a device rotor.
Figure 7:
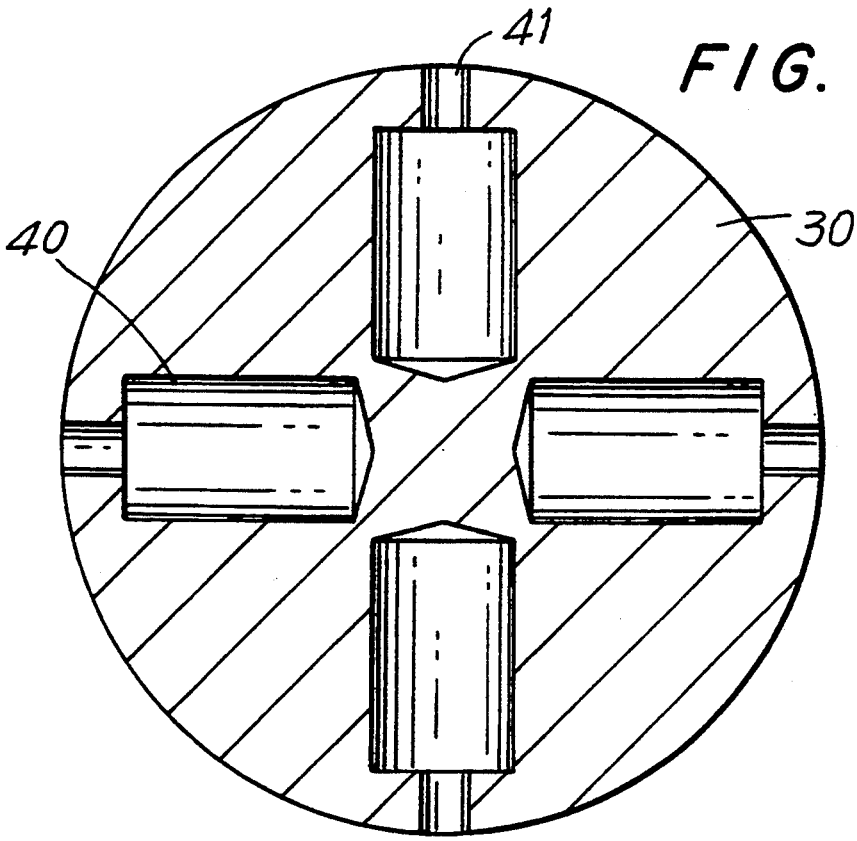
FIG. 7 shows a cross sectional view of a device rotor utilizing a combined space-saving arrangement of four equally-shaped Helmholtz resonator cavities provided within the rotor.

The cut off device rotor 30 can alternatively be provided with a plurality of Helmholtz type resonator cavities 40 having various geometries to cover the required resonant frequencies, as generally shown by FIG. 6. These Helmholtz resonator cavities typically have a small diameter mouth opening 41 having diameter d and neck length 1 leading to a resonator cavity 42 having a larger diameter and volume V. The Helmholtz resonator cavities 40 are usually arranged symmetrically about the axis of resonator rotor 30 in sets of two, three or four resonators equally spaced circumferentially, the latter being shown in cross-sectional view by FIG. 7.

Figure 8:
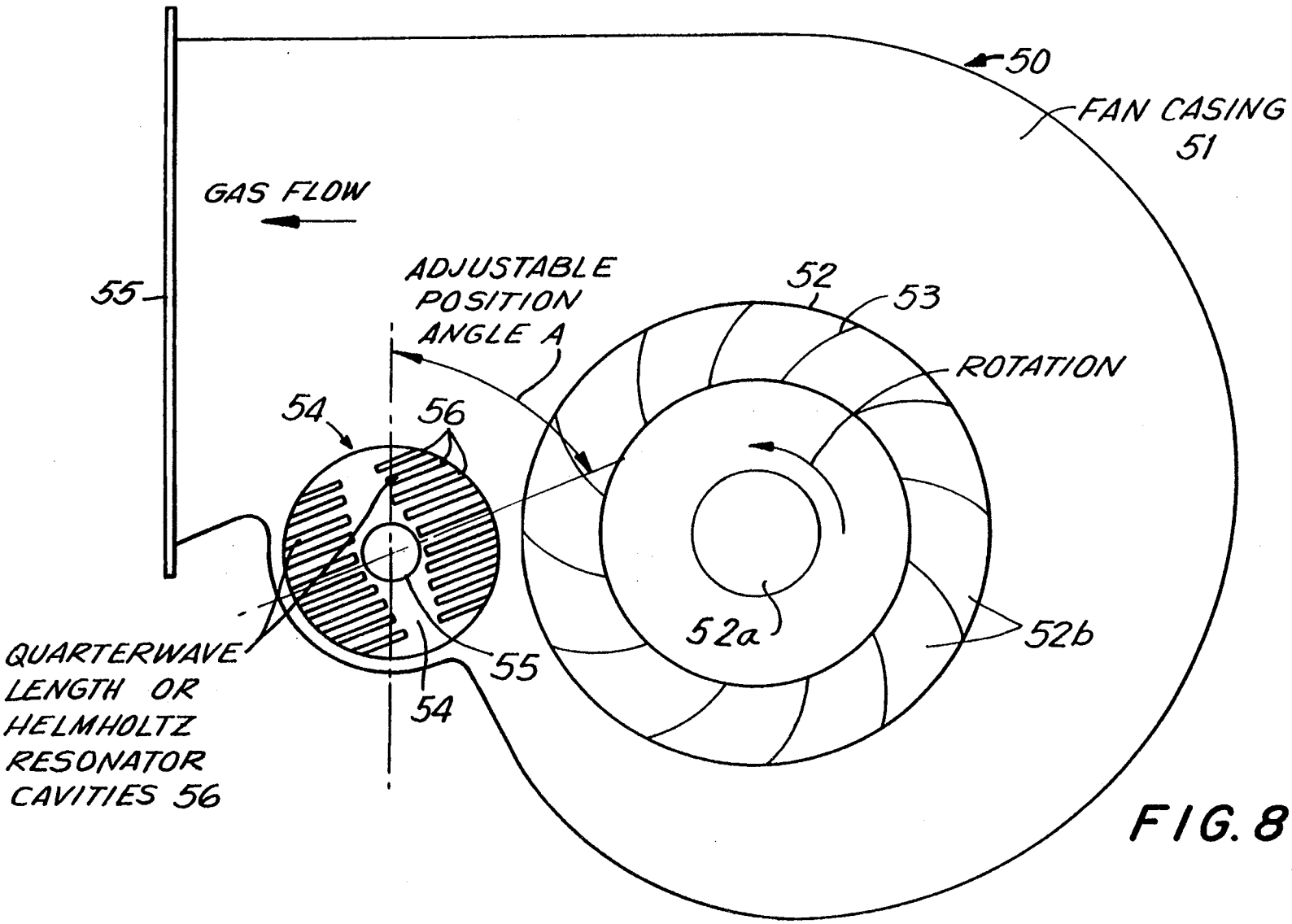
FIG. 8 shows a side elevation view of a centrifugal fan assembly having an alternative resonator rotor for which the angle of the resonant cavities is adjustable relative to the fan impeller.

For centrifugal fan/resonator rotor configurations in which the fan gas flow velocity relative to the resonator rotor does not cause acoustic plugging of the resonator cavities, an alternative arrangement for the rotary throat cutoff device can be used, for which the angle of resonant cavities in the rotor is adjustable relative to the plane of the fan impeller axis. For this embodiment of the invention shown by FIG. 8, centrifugal fan 50 has housing 51 and contains rotatable impeller 52 having multiple blades 53 similar to FIG. 3. A throat cutoff device 54 is provided which is rotatably attached to housing 51 near the periphery of fan impeller 52 and the fan discharge opening 55. The rotary cutoff device 54 contains a plurality of substantially parallel resonator cavities 56. The cutoff device 54 is rotated about its longitudinal axis by an extended shaft 55, so that an angle "A" of cavities 56 relative to a vertical plane or to the common plane through the fan impeller axis can be adjusted so as to produce maximum sound absorption in the cavities 56, and thereby minimize the noise pulsations produced during operation of the bladed impeller 52.

This invention will be further described by use of a typical example of a rotary cutoff device attached onto a centrifugal fan assembly, which should not be construed as limiting in scope.

EXAMPLE

A rotary cutoff device is constructed and attached onto a centrifugal fan adjacent the fan housing discharge throat opening, as generally shown by FIG. 3. The centrifugal fan and rotary cutoff device have the following dimensions and operating characteristics:

| | |
|---|---|
| Fan impeller diameter, in. | 18 |
| Rotor diameter, in. | 8 |
| Rotor length, in. | 14 |
| Number of resonator cavities in rotor | 60 |
| Cavity diameter, in. | 0.625 |
| Fan rotational speed, rpm | 2,300 |
| Blade pass frequency of fan impeller and double blade pass frequency, $H_3$ | 460,920 |
| Rotor speed either direction, rpm | 500–6,000 |
| Fan blade throat cutoff speed, fps | 200 |
| Rotor surface speed, fps | 70–200 |
| Distance between impeller and rotor outer surfaces, in. | 2 |

By operation of the cutoff device rotor at variable speed in either direction relative to the fan impeller, the acoustic noise usually generated by the blades of the fan impeller passing a conventional stationary throat cutoff point in the fan housing is substantially reduced by the noise being effectively absorbed in the numerous cavities of the cutoff device rotor.

Although this invention has been described broadly and in terms of specific embodiments, it will be understood that modifications and variations can be made within the scope as defined by the following claims.

We claim:

1. A centrifugal fan assembly including a rotary resonator cutoff device adapted for achieving noise reduction from the fan, comprising:

(a) a housing having an inlet and a discharge opening and containing a rotatable bladed impeller attached to a drive means;

(b) a casing attached onto said housing of the centrifugal fan at a location near its discharge opening;

(c) a cylindrical-shaped rotor rotatably supported within said casing, said rotor having a plurality of resonator cavities of varying depth provided transfer to the rotor for absorption of sound pulses generated by rotation of the fan impeller, said cavities each having a length/diameter ratio in the range of 8/1–16/1; and (d) drive means connected to said rotor for rotating the rotor within said casing at a speed relative to the rotary blade cutoff speed of the centrifugal fan impeller, whereby noise generated by operation of the centrifugal fan is significantly reduced by being absorbed within the resonator cavities of said rotor.

2. A rotary resonator cutoff device adapted for use with a centrifugal fan for reducing noise generated by operation of a bladed impeller of the fan, the device comprising:

a casing having dual end plates adapted for attachment onto a housing of a centrifugal fan at a location adjacent and below the housing discharge opening;

a cylindrical-shaped rotor rotatably supported within said casing, said rotor having a plurality of resonator cavities of varying depth provided in the rotor transverse to the rotor axis for absorption of sound pulses generated by rotation of the fan, said cavities each having a length/diameter ratio in the range of 8/1–16/1; and drive means connected to one end of said rotor for rotating it within said casing at a speed relative to the rotary blade cutoff speed of the centrifugal fan impeller, whereby noise generated by operation of the centrifugal fan is appreciably reduced by being absorbed within the resonator cavities of said rotor.

3. A rotary cutoff resonator device adapted for use with a centrifugal fan for reducing noise generated by operation of a bladed impeller of the fan, comprising:

a casing adapted for attachment onto a housing of a centrifugal fan near a discharge opening in the housing;

a cylindrical-shaped rotor rotatably supported within said casing, said rotor having a plurality of resonator cavities of varying depth provided in the rotor for absorption of sound pulses generated by rotation of the fan impeller; and means connected to said rotor for rotating it within said casing relative to the centrifugal fan impeller, whereby noise generated by operation of the centrifugal fan is appreciably reduced by being absorbed within the resonating cavities of said rotor.

4. A rotary resonator device according to claim 3, wherein said rotor is rotatably supported at each end by bearing means attached to the fan housing.

5. A rotary resonator device according to claim 3, wherein said rotor is rotatable in the same direction as the impeller of the centrifugal fan to which it is attached.

6. A rotary resonator device according to claim 3, wherein said rotor is rotatable in a direction opposite to that of the impeller of the centrifugal fan to which it is attached.

7. A rotary resonator device according to claim 3, wherein the resonator cavities in said rotor are cylindrical-shaped.

8. A rotary resonator device according to claim 3, wherein said resonator cavities are oriented transverse to the rotor axis.

9. A rotary resonator device according to claim 3, wherein said resonator cavities in said rotor each has a length/diameter ratio in the range of 8/1–16/1.

10. A rotary resonator device according to claim 3, wherein the resonator cavities are of the Helmholtz resonator type.

11. A rotary resonator device according to claim 3, wherein said casing and rotor are attached to a housing of a centrifugal fan at a location adjacent and below the fan discharge opening.

12. A rotary resonator device according to claim 3, wherein said rotor includes rotary drive means and is rotatable at surface speeds which are variable with the rotary speed of the centrifugal fan impeller.

13. A rotary resonator device according to claim 3, wherein said rotor has diameter of 8–24 inches, length of 12–36 inches, and contains 30–100 resonator cavities.

14. A rotary resonator device according to claim 11, wherein the angle of the resonator cavities in said rotor is rotatably adjustable relative to the fan impeller axis.

15. A method for reducing noise produced by operation of centrifugal fans, comprising:

(a) attaching a rotary cut off device onto a centrifugal fan housing at a location near the housing discharge opening, said device including a rotor which is rotatable in a casing and contains a plurality of resonator cavities sized for absorption of sound pulses generated during rotation of the fan impeller;

(b) operating the centrifugal fan impeller at a rotary speed selected to provide a desired gas flow rate and discharge pressure from the fan; and (c) rotating said rotor at a surface speed equal to 30–100% that of the fan bladed impeller so as absorb noise in the rotor resonator cavities and provide reduced noise from the centrifugal fan.

16. A method for reducing centrifugal fan noise according to claim 15, wherein the fan impeller rotary speed is 720–3,600 rpm.

17. A method according to claim 15, wherein the blade pass sound frequency generated by the impeller blading is 120–720 Hz, and the noise reduction is 20–25 decibels.

* * * * *